US011049447B2

(12) United States Patent
Chaji

(10) Patent No.: US 11,049,447 B2
(45) Date of Patent: *Jun. 29, 2021

(54) SYSTEMS AND METHODS OF PIXEL CALIBRATION BASED ON IMPROVED REFERENCE VALUES

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/594,416

(22) Filed: Oct. 7, 2019

(65) Prior Publication Data

US 2020/0035153 A1 Jan. 30, 2020

Related U.S. Application Data

(63) Continuation of application No. 16/413,693, filed on May 16, 2019, now Pat. No. 10,475,376, which is a continuation of application No. 16/059,299, filed on Aug. 9, 2018, now Pat. No. 10,339,860, which is a continuation of application No. 15/230,397, filed on Aug. 6, 2016, now Pat. No. 10,074,304.

(30) Foreign Application Priority Data

Aug. 7, 2015 (CA) ..... CA 2900170

(51) Int. Cl.
*G09G 3/3225* (2016.01)

(52) U.S. Cl.
CPC ... *G09G 3/3225* (2013.01); *G09G 2300/0408* (2013.01); *G09G 2320/029* (2013.01); *G09G 2320/045* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS 5,917,692 A * 6/1999 Schmitz ..... F02D 41/20 361/187
2003/0094930 A1* 5/2003 Pierre ..... G09G 3/22 323/275
2008/0117144 A1* 5/2008 Nakano ..... G09G 3/006 345/76
2010/0245324 A1* 9/2010 Minami ..... G09G 3/3233 345/211
2011/0234644 A1* 9/2011 Park ..... G09G 3/3208 345/690
2012/0299973 A1* 11/2012 Jaffari ..... G09G 3/3258 345/690

(Continued)

*Primary Examiner* — Duane N Taylor, Jr.
(74) *Attorney, Agent, or Firm* — Stratford Managers Corporation

(57) ABSTRACT

What is disclosed are systems and methods of compensation of images produced by active matrix light emitting diode device (AMOLED) and other emissive displays. The electrical output of a pixel is compared with a reference value to adjust an input for the pixel. In some embodiments an integrator is used to integrate a pixel current and a reference current using controlled integration times to generate values for comparison.

20 Claims, 3 Drawing Sheets

(56) References Cited

U.S. PATENT DOCUMENTS

2013/0307834 A1* 11/2013 Chaji ..... G01R 19/0092
345/211
2016/0012798 A1* 1/2016 Oh ..... G09G 3/325
345/205

* cited by examiner

SYSTEMS AND METHODS OF PIXEL CALIBRATION BASED ON IMPROVED REFERENCE VALUES

PRIORITY CLAIM

This application claims priority to Canadian Application No. 2,900,170 which was filed Aug. 7, 2015 and which is hereby incorporated by reference in its entirety.

FIELD OF THE INVENTION

The present disclosure relates to image compensation for light emissive visual display technology, and particularly to compensation systems and methods which compare electrical outputs of pixels with expected or reference values in compensating images produced by active matrix light emitting diode device (AMOLED) and other emissive displays.

BRIEF SUMMARY

According to one aspect there is provided a method for compensating an image produced by an emissive display system having pixels, each pixel having a light-emitting device, the method comprising: integrating a pixel current output from the pixel for a pixel integration time generating an integrated pixel current value; comparing the integrated pixel current value with a reference signal, generating at least one comparison value; and adjusting an input for the pixel with use of the comparison value.

In some embodiments, the reference signal is a reference current, and comparing the integrated pixel current value with the reference signal comprises integrating the reference current for a reference integration time generating an integrated reference current value and comparing the integrated reference current value with the integrated pixel current value, generating the at least one comparison value.

In some embodiments, a ratio of the pixel integration time to the reference integration time is controlled with use of an expected ratio of an expected magnitude of the pixel current to a magnitude of the reference current.

In some embodiments, the pixel integration time and the reference integration time comprise non-overlapping time periods. In some embodiments, the pixel integration time and the reference integration time comprise overlapping time periods.

In some embodiments, the reference signal is an analog reference value, and comparing the integrated pixel current value with the reference signal comprises storing the stored analog reference value in a capacitor of at least one integrator and comparing the stored analog reference value with the integrated pixel current value, generating the at least one comparison value.

In some embodiments, storing the analog reference value comprises one of directly charging the capacitor up to the analog reference value and controlling an input of the at least one integrator to charge the capacitor up to the analog reference value. In some embodiments, the analog reference value is controlled with use of an expected magnitude of the pixel output.

According to another aspect there is provided a method for compensating an image produced by an emissive display system having pixels, each pixel having a light-emitting device, the method comprising: sampling a pixel output from the pixel generating a sampled pixel value; integrating a reference current for a reference integration time generating an integrated reference current value; comparing the sampled pixel value with the integrated reference current value, generating at least one comparison value; and adjusting an input for the pixel with use of the comparison value.

In some embodiments, the reference integration time is controlled with use of an expected magnitude of the pixel output.

According to a further aspect there is provided a method for compensating an image produced by an emissive display system having pixels, each pixel having a light-emitting device, the method comprising: sampling a pixel output from the pixel with use of at least one integrator generating a sampled pixel value; comparing the sampled pixel value with a digital reference value, generating at least one comparison value; and adjusting an input for the pixel with use of the comparison value.

According to another further aspect there is provided a system for compensating an image produced by an emissive display system having pixels, each pixel having a light-emitting device, the system comprising: at least one integrator coupled via a pixel switch to a pixel of said emissive display system for measuring an electrical output of the pixel; a comparator digitizer coupled to the at least one integrator for comparing the electrical output of the pixel with a reference signal, generating at least one comparison value; and a data processing unit for adjusting an input for the pixel with use of the comparison value.

Some embodiments further provide for a reference current source coupled via a reference switch to the at least one integrator, in which the reference signal is a reference current produced by the reference current source, the at least one integrator measures the electrical output of the pixel by integrating a pixel current output from the pixel for a pixel integration time generating an integrated pixel current value, the at least one integrator for integrating the reference current for a reference integration time generating an integrated reference current value, and the comparator digitizer compares the electrical output of the pixel with the reference signal by comparing the integrated reference current value with the integrated pixel current value, generating the at least one comparison value.

In some embodiments, the pixel switch is for controlling the pixel integration time and the reference switch is for controlling the reference integration time, a ratio of the pixel integration time to the reference integration time is controlled with use of an expected ratio of an expected magnitude of the pixel current to a magnitude of the reference current.

Some embodiments further provide for a reference current source coupled via a reference switch to the at least one integrator, in which the reference signal is a reference current produced by the reference current source, the at least one integrator measures the electrical output of the pixel by sampling a pixel output from the pixel generating a sampled pixel value, the at least one integrator for integrating the reference current for a reference integration time generating an integrated reference current value, and the comparator digitizer compares the electrical output of the pixel with a reference signal by comparing the integrated reference current value with the sampled pixel value, generating the at least one comparison value.

In some embodiments, the reference switch is for controlling the reference integration time, and the reference integration time is controlled with use of an expected magnitude of the pixel output.

In some embodiments, the reference signal is an analog reference value, the at least one integrator comprises a capacitor, the at least one integrator for storing the analog reference value in said capacitor, the at least one integrator measures the electrical output of the pixel by integrating a pixel current output from the pixel for a pixel integration time generating an integrated pixel current value, and the comparator digitizer compares the electrical output of the pixel with the reference signal by comparing the stored analog reference value with the integrated pixel current value, generating the at least one comparison value.

In some embodiments, the at least one integrator stores the analog reference value in said capacitor by one of directly charging the capacitor up to the analog reference value and having an input of the at least one integrator controlled to charge the capacitor up to the analog reference value. In some embodiments, the analog reference value is controlled with use of an expected magnitude of the pixel output.

In some embodiments, the at least one integrator measures the electrical output of the pixel by sampling a pixel output from the pixel generating a sampled pixel value, the reference signal is a digital reference value, and the comparator digitizer compares the electrical output of the pixel with the reference signal by comparing the digital reference value with the sampled pixel value, generating the at least one comparison value.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
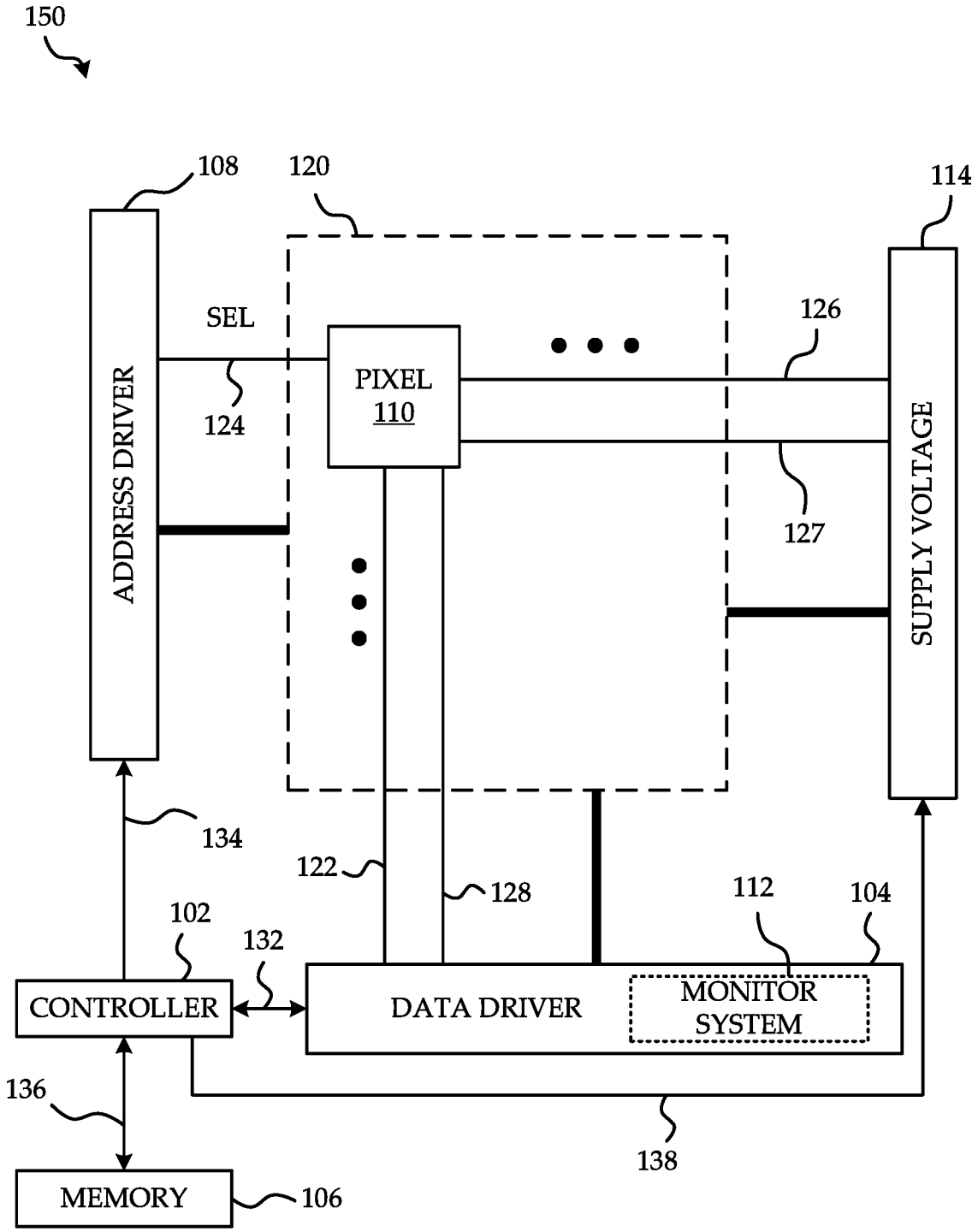
FIG. 1 illustrates an example display system which participates in and whose pixels are to be compensated with use of the compensation systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduces the image represented by the image data.

To avoid error propagation in the calibration of pixels in an array structure of a display, often the best approach is to adjust the input to the pixel to obtain the proper output from the pixel. In one case, a current is the output of the pixel. Here, the current output of the pixel is compared with a reference current corresponding to the proper current and the input to the pixel is adjusted so that the output current is the same as the reference current. One of the challenges in this case is generating accurate reference current at different levels of magnitude. Disclosed herein are systems and methods to reduce the complexity associated with generating low current levels as reference currents and otherwise using measurements of pixel outputs for changing the inputs to the pixels and hence compensating for operating inaccuracies.

While the embodiments described herein will be in the context of AMOLED displays it should be understood that the systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 112 can be integrated with the data driver 104, or can be a separate stand-alone system. In particular, the monitoring system 112 can optionally be implemented by monitoring the current and/or voltage of the data line 122 during a monitoring operation of the pixel 110, and the separate monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110. In another example a pixel current of a pixel 110 may be measured and compared with a proper or expected current in the monitor 112 or another integrated or separate system (not shown) cooperating with the monitor 112, and as a result of that comparison calibration or inputs to the pixel are adjusted to cause it to output the proper expected current. Generally, any data utilized for purposes of calibrating or compensating the display for the above mentioned and similar deficiencies will be referred to herein as measurement data.

Monitoring system 112 may extend to external components (not shown) for measuring characteristics of pixels which are utilized in subsequent compensation, and may include current sources, switches, integrators, comparator/digitizer, and data processing as described below, for directly measuring the output of pixels and comparing it to reference currents or reference data. Generally speaking monitoring system 112 depicted in FIG. 1 along with external modules performs necessary measurements of pixels for use in various compensation methods.

Figure 2A:
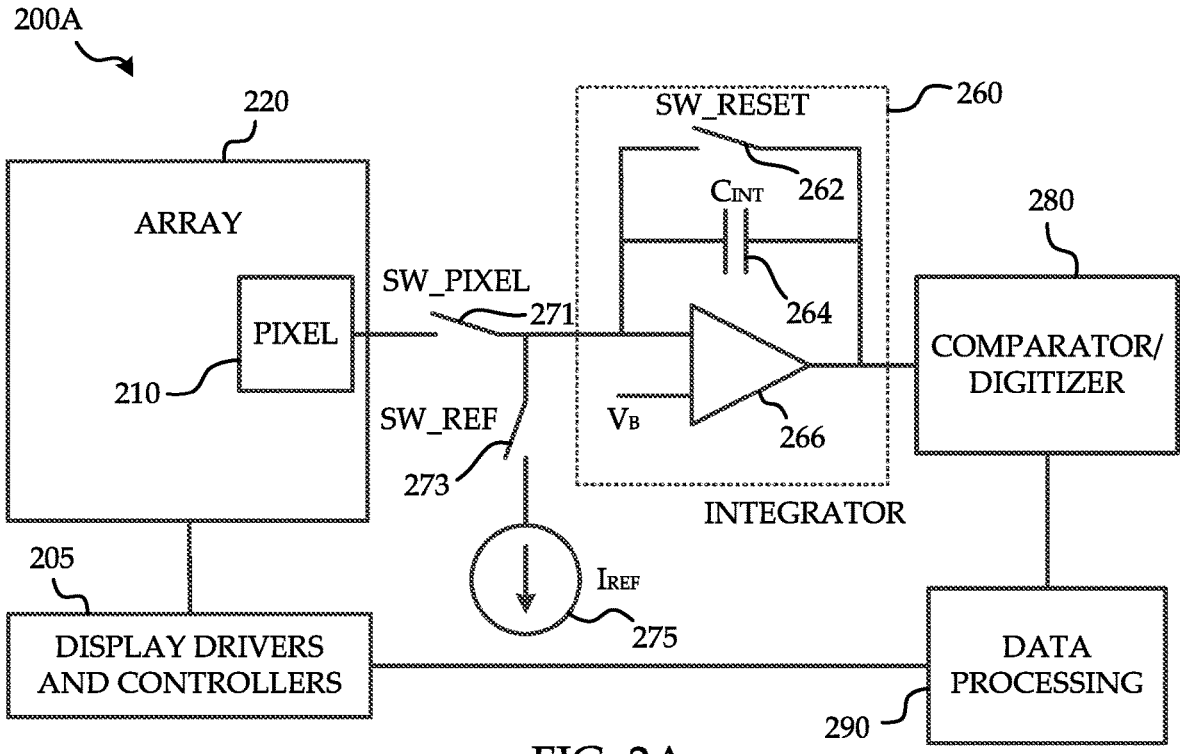
FIG. 2A is a system block diagram of a display system including a charge based comparator for comparing a reference current with current output from a pixel.

Referring to FIG. 2A, part of a display system that participates as a charge based comparator system 200A according to an embodiment which compares a reference current with current output from a pixel 210 will now be described.

The comparator system 200A includes a display array 220 which includes a pixel 210 which for example correspond respectively to the display array panel 120 and pixel 110 of FIG. 1. Coupled to and driving the display array 220 are display drivers and controllers 205 which for example correspond to various drivers and controllers illustrated in FIG. 1 such as the address driver 108, controller 102, memory 106, data driver 104, etc. An output of the pixel 210 is coupled via a pixel switch 271 (SW_PIXEL) to an input of an integrator 260. A reference current source 275 producing a reference current $I_{ref}$ is coupled via a reference switch 273 (SW_REF) to the input of the integrator 260. The integrator 260 includes an amplifier 266 having as its first input the input of the integrator 260 and having $V_B$ as its second input, $V_B$ being set appropriately for integration of the pixel current as discussed below. Connected across and parallel to the first input and an output of the amplifier 266 are a capacitor 264 of capacitance $C_{int}$ and a reset switch 262 (SW_RESET). The output of the amplifier 266 is coupled to the output of the integrator 260 which is coupled to an input of a comparator/digitizer 280, which has an output coupled to a data processing 290 unit. An output of data processing 290 unit is coupled to the display drivers and controllers 205.

The pixel and reference switches 271 273, the current source 275, the integrator 260, the comparator/digitizer 280, and the data processing 290 unit may be implemented in any combination of the controller 102, data driver 104, or monitor 112 of FIG. 1 or may be implemented in separate modules or partly in combination with the controller 102, data driver 104, or monitor 112.

In this method, the pixel current and the reference current are integrated to create two voltages that can be compared and digitalized for making a decision for adjusting the pixel input. Here, the integration time of the reference current $I_{ref}$ can be controlled (by controlling the pixel switch 271 and the reference switch 273) to be shorter than the integration time of the pixel current. As a result to obtain effects in the integrator due to the reference current similar to that produced by the pixel current, the reference current is chosen to be proportionally larger than the pixel current, which proportion is similar to the proportion by which the time of integration for the pixel current is larger than the time of integration for the reference current. For example, if the integration time of the reference current is K times smaller than that of the pixel current, the reference current is set to be K times larger. In a similar manner, in a case of sampling the output charge from the pixel and comparing it with a reference charge created by a reference current, the integration time and magnitude of the reference current can be chosen to match the output charge from the pixel. Given the relatively small currents provided by the pixels, instead of utilizing a relatively inaccurate reference current over a long integration time, the accuracy of the comparison is improved by utilizing a relatively larger reference current exhibiting greater accuracy, over a relatively shorter integration time period.

FIG. 2A illustrates a simplified embodiment of a comparator system 200A capable of performing integration of currents having different integration times for the pixel current and the reference current. It is to be understood that the integration time ratio can be used with other embodiments described herein. Although only one integrator 260 is illustrated as working in concert with switches 271, 273 which can be used to time multiplex the input of the integrator 260 between the reference current and the pixel current, another embodiment utilizes two integrators, each of which produces an input for the comparator/digitizer 280. In either case the comparator/digitizer 280 takes the two input values of integrated current to create a digital output for data processing 290.

After the integration of the reference current and pixel current, the digitizer/comparator 280 creates a digital value that is used by the data processing 290 unit to adjust the input which is to be provided to the pixel by the display drivers and controllers 205. After, the pixel data is finalized, the input data and/or the reference current can be used to calibrate the input of the pixel circuit. This single adjustment to the input to the pixel circuit in many display systems does not guarantee that the pixel 210 will generate the proper expected current but generally will cause the pixel to produce a current which is closer to the proper current than that which was previously produced. In some embodiments, therefore, multiple comparisons of pixel output with reference data will occur prior to all the various the adjustments to the input for the pixel finally arrives at a level which causes the pixel 210 to produce the desired output. The initial and/or this final level of adjustment can be used to update calibration data such as that discussed in association with FIG. 1.

The integration times can be controlled by the pixel switch 271 in series with the pixel 210 and the reference switch 273 in series with the current source 275 and also with use of the reset switch 262. The time that the pixel switch 271 (or reference switch 273) in series with the pixel 210 (or reference current source 275) is ON and the integrator 260 is in integration mode (as controlled by the reset switch 262) defines the integration time of the pixel current (or reference current). When the reset switch 262 is ON, the integrator 260 is not in integration mode. As a result, the overlap of the pixel and reference switches' 271, 273 ON time and the reset switch's 262 OFF time define the integration times. Although the above methods may be utilized with a time-multiplexed scheme, i.e. with the pixel switch 271 and the reference switch 273 being controlled to be ON at different times during integration by the integrator 260, for some embodiments the integration of the pixel current and the reference current may overlap in time.

In another embodiment, the difference between the pixel current and the reference current is integrated to create at least one output voltage. In this case, and as discussed above, the input reference current $I_{ref}$ can be applied to the integrator during a smaller time. To obtain a difference, the sign of the reference current $I_{ref}$ may be arranged to be the opposite of that produced by the pixel. Optionally, when using time multiplexing the comparator 280 could simply subtract one value from another. As a result, the total effect will be $$K_{int}(I_{pixel}*t_{pixel}-I_{ref}*t_{ref}) \quad (1)$$

where '$K_{int}$' is the integrator gain, $I_{pixel}$ is the pixel current, $t_{pixel}$ is the integration time for the pixel current, $I_{ref}$ is the reference current, and $t_{ref}$ is the integration time for the reference current. A similar technique can be used also if the pixel charge (voltage) is being sampled and compared with the reference current. In this case, the output will be $$K_q*Q_{pixel}-K_i*I_{ref}*t_{ref} \quad (2)$$

where $Q_{pixel}$ is pixel charge (or voltage), $K_q$ is the gain of the integrator 260 when used as a sampler for charge, and $K_i$ is the gain of the integrator 260 for current. Based on the result, the input of the pixel is adjusted so as to make the value of either equation become equal to a given value (e.g. zero). Further refinements in the adjustment to the input of the pixel may be made after further measurements and comparisons of current as described are performed.

In the embodiment depicted in FIG. 2A, the pixel current and reference current are applied during the same integration operation to one integrator 260. However, the ON times of the pixel switch 271 and the reference switch 273 defines the integration ratio. For example, during the time the reset switch 262 is OFF and the integrator 260 in integration mode, the ON time of pixel switch 271 in series with pixel 210 and the ON time of the reference switch 273 in series with reference current source 275 define the integration ratio. In another case, where a charge or voltage is sampled from the pixel, the ON time of the reference switch 273 in series with reference current source 275 defines the integration time of the reference current.

In any of the above cases, the integration times for the reference current and/or the pixel current can be adjusted based on expected reference current and pixel current magnitudes. For example, for very small expected reference current, the integration time ratio can be larger so that the actual integrated reference current value is larger while for large reference currents, the integration time ratio can be smaller so that the actual integrated reference current value is not too large. For example, for 1 nA expected reference current, the integration time ratio can be 10 and so the actual measured reference "current" corresponds to 10 nA. In another example, for 1 uA expected reference current, the integration time ratio can be 0.1 or (one). As a result, the actual measured reference "current" will correspond to 100 nA (1 uA). It should be understood that although the integrator in the act of measuring the current integrates a current, the analog form it takes in the capacitor is one of voltage or equally charge, and is dependent both upon the magnitude of the currents and the integration time. It is to be understood, therefore that integrated current values although representing and corresponding to currents are actually voltage or charge stored in the capacitor 264.

Figure 2B:
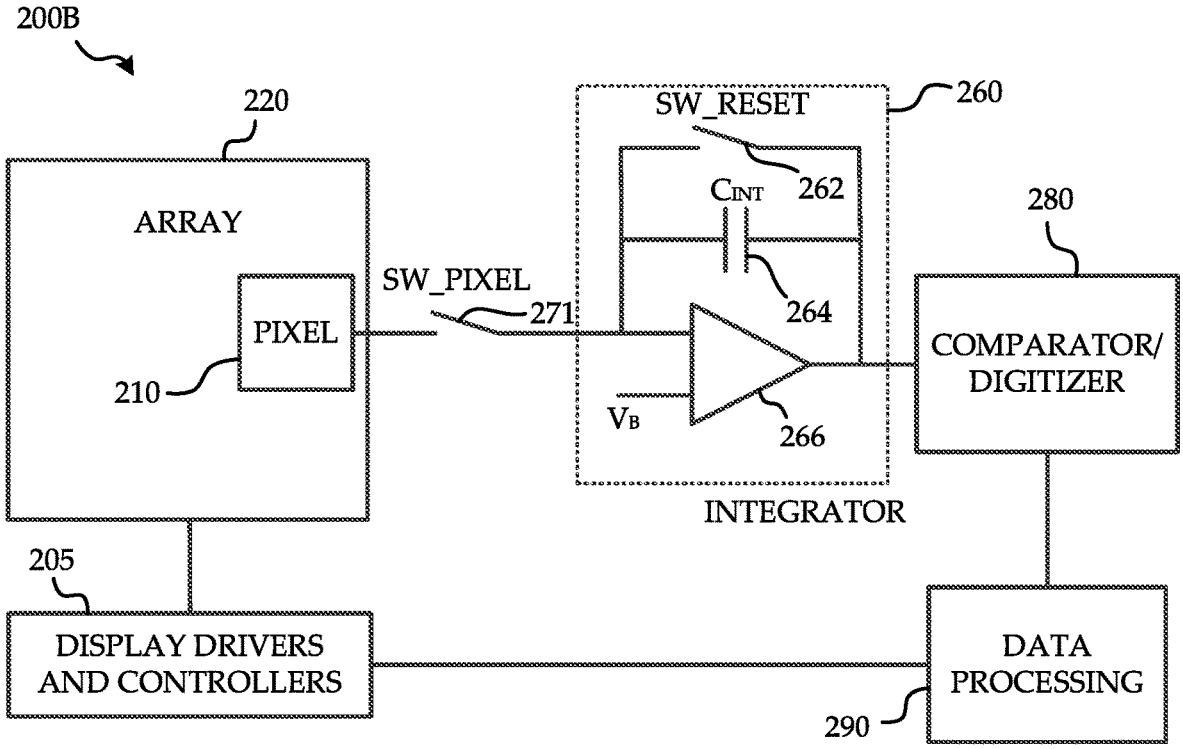
FIG. 2B is a system block diagram of a display system including a charge based comparator for comparing a stored reference charge with a charge integrated from a current output from a pixel.

Referring to FIG. 2B, part of a display system that participates as a charge based comparator system 200B according to one embodiment which compares a stored reference charge with a charge integrated from a current output from a pixel 210 will now be described.

The charge based comparator 200B of FIG. 2B is substantially the same as that described in association with FIG. 2A but differing most notably by not including the reference current source 275 or the reference switch 273. Instead of creating reference voltage (or charge) in a capacitor with a reference current, a predefined voltage (or charge) is used. As was described above, in previous embodiments the effect of a reference current can be calculated as $$V_{ref}=K_{ref}*I_{ref}*t_{ref}. \quad (3)$$

In the embodiment of FIG. 2B, the capacitor 264 of the integrator 260 is directly charged (or set) with the charge (or voltage) corresponding to a reference current as given by equation (3). The resulting charge $Q_{ref}$ is easily determined from $V_{ref}$ and the capacitance $C_{int}$ of the capacitor 264. Alternatively, since there is no reference current source, an estimation of the expected voltage or charge to be measured from the pixel is made. The capacitor 264 is then charged to the voltage or charge expected to be measured from the pixel, optionally of inverse sign to that expected. Then the pixel current (charge or voltage) is actually integrated (or sampled). Here the output will be $$\Delta V=V_{pixel}-V_{ref}(\text{or } \Delta Q=Q_{pixel}-Q_{ref}) \quad (4)$$

Here, $V_{pixel}$ is either the sampled voltage from the pixel or the result of integrated pixel current (or integrated pixel charge).

For the embodiment illustrated in FIG. 2B, the voltage or charge to be imparted to the capacitor 264 of the integrator 260 can be applied directly. For example, instead of a reset switch 262 (SW_RESET) or connected in parallel to it, the capacitor 264 having capacitance $C_{int}$ is directly charged to a specific voltage or charge defined as outlined above by a charging element (not shown). In another case, $V_B$ can be used to create the voltage or charge value during an integration time. For example, $V_B$ is changed from V1 to V2 during the integration. The change in voltage and the line capacitance creates a charge that will be transferred to capacitor 264 of the integrator 260. The value will be $$Q_{ref}=C_{line}*(V1-V2) \quad (5)$$

where $C_{line}$ is the effective capacitance at input of the integrator 260. Also the effect can be created by an input capacitor that is connected to the input of the integrator, and a step voltage applied to the input capacitor can create a similar reference voltage or charge. In the embodiment depicted in FIG. 2B, the digitizer/comparator 280 creates a digitized value based on the output of the integrator and provides it to the data processing 290 unit. The data processing 290 unit adjusts the input of the pixel according to the digitized value so as to make the output of the integrator (digitizer) become a predefined value (e.g. zero). In this case, the final input and/or the reference value created on the integrator can be used to calibrate the pixel.

Figure 2C:
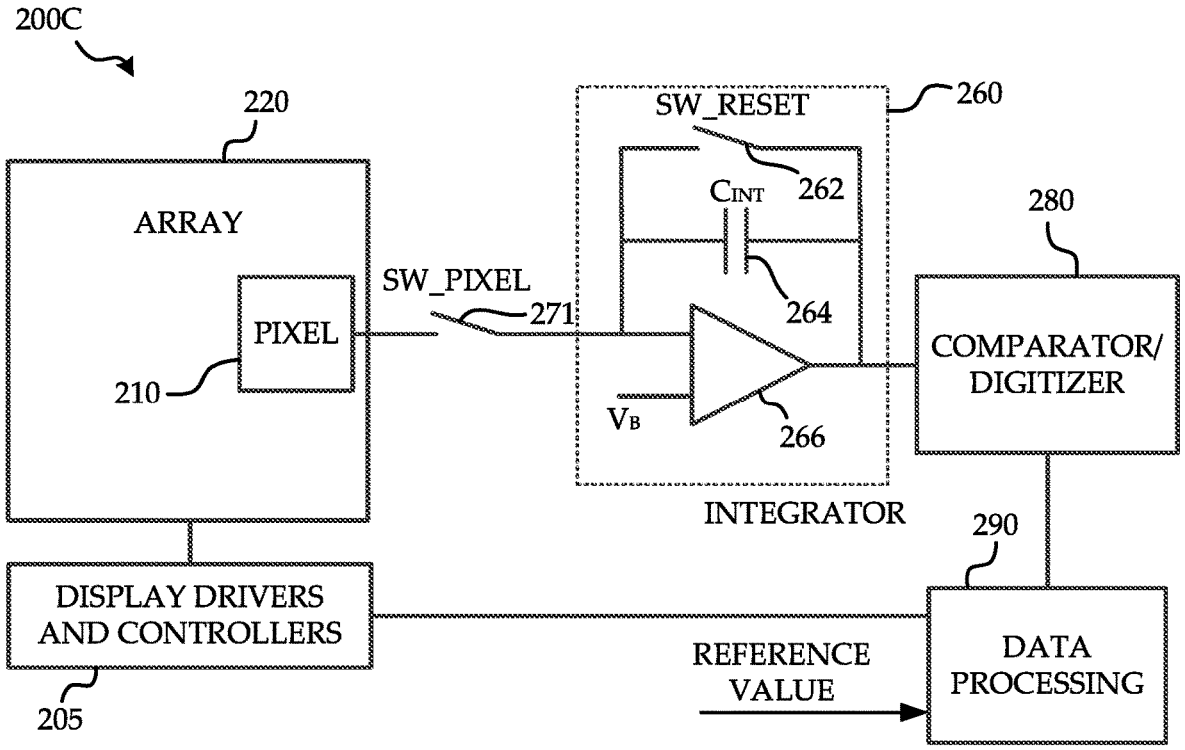
FIG. 2C is a system block diagram of a display system including a charge based comparator for comparing a digital reference value with a value of a charge integrated from a current output from a pixel.

Referring to FIG. 2C, part of a display system that participates as a charge based comparator system 200C according to one embodiment which compares a digital reference value with a value of a charge integrated from a current output from a pixel 210, will now be described.

The charge based comparator 200C of FIG. 2C is substantially the same as that described in association with FIG. 2B but differing most notably by including in data processing by the data processing 290 unit, use of a digital reference value. In the embodiment of FIG. 2C, the pixel output ($V_{pixel}$ or $Q_{pixel}$) is sampled and digitized. The digitized output representing $V_{pixel}$ or $Q_{pixel}$ is compared to a respective reference value, digital $V_{ref}$ or $Q_{ref}$.

In the embodiment illustrated in FIG. 2C, the reference values are generated digitally. The pixel current or charge is integrated (or sampled) by the integrator 260 and digitized by the comparator/digitizer 280. The output of the comparator/digitizer 280 is compared with a given digital reference value by the data processing 290 unit. Based on that comparison, the input of the pixel 210 is adjusted. This process continues till the difference between the reference value and the digitized values of the pixel output is equal to a given threshold (e.g. zero). In this case, the final input of the pixel and/or the reference value is used to calibrate the input of the pixel circuit.

Figure 2D:
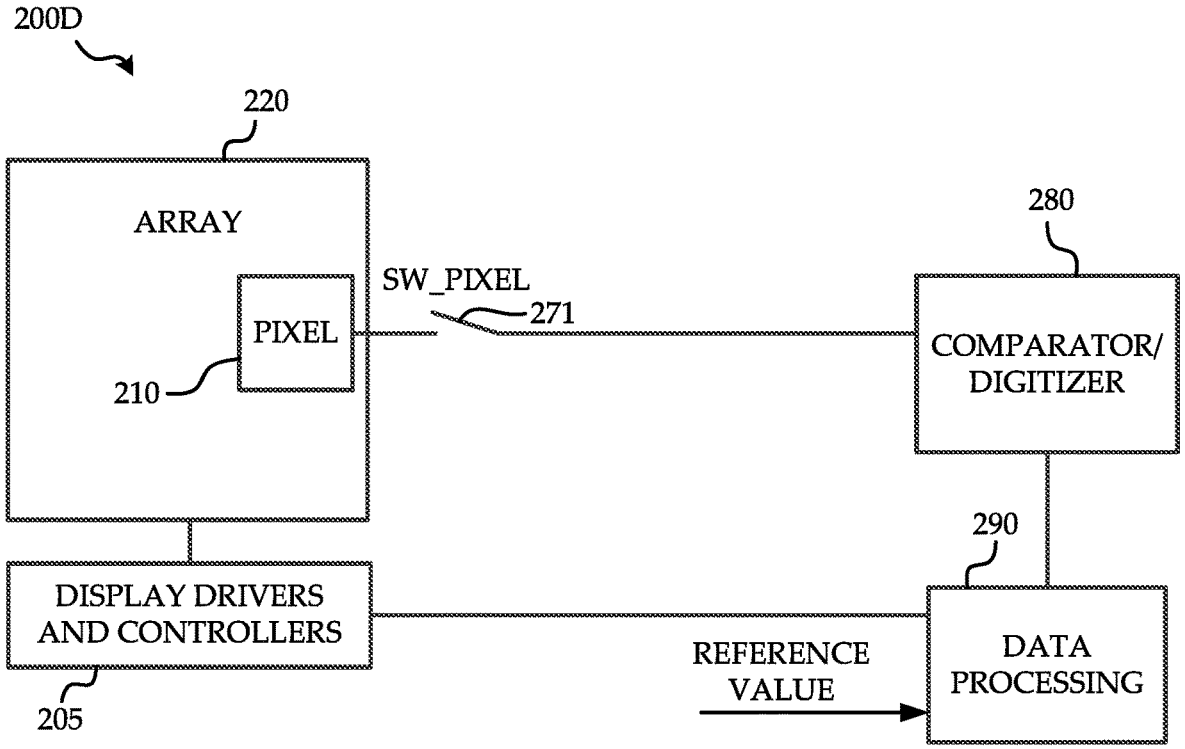
FIG. 2D is a system block diagram of a display system including a comparator for comparing a digital reference value directly with output from a pixel.

Referring to FIG. 2D, part of a display system that participates as a comparator system 200D according to one embodiment which compares a digital reference value directly with output from a pixel 210, will now be described.

The comparator system 200D of FIG. 2D is similar to that described in association with FIG. 2C but differing most notably by not including an integrator 260. In the embodiment of FIG. 2D, the reference values to be compared with the output of the pixel 210 are generated digitally. The pixel's output charge or voltage is sampled and digitized by the comparator/digitizer 280 (or simply a digitizer). The output of the comparator/digitizer 280 is compared by the data processing 290 unit with a given reference value and based on that the input of the pixel is adjusted. This process continues till the pixel difference between reference value and the digitized values is equal to a given threshold (e.g. zero). In this case, the final input of the pixel and/or the reference value is used to calibrate the input of the pixel circuit.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for compensating an image produced by an emissive display system having pixels, each pixel having alight-emitting device, the method comprising:

comparing an electrical output of a pixel with a reference, generating at least one comparison value; and adjusting an input for the pixel with use of the at least one comparison value.

2. The method of claim 1, wherein said reference comprises a reference signal.

3. The method of claim 2, wherein said reference signal comprises an analog reference signal.

4. The method of claim 2, wherein said reference signal comprises one of a reference current and a reference voltage.

5. The method of claim 1, wherein said reference comprises a reference charge.

6. The method of claim 1, wherein said reference comprises a digital reference value.

7. The method of claim 1, wherein said input for the pixel comprises a programming input for the pixel.

8. The method of claim 7, wherein said adjusting comprises updating calibration data for compensating said programming input for the pixel.

9. The method of claim 1, wherein said input for the pixel is adjusted repeatedly until, at a final value of the adjusted input for the pixel, said comparison value equals a predefined value.

10. The method of claim 9, further comprising updating calibration data to compensate a programming of the pixel with use of the final value of the adjusted input for the pixel.

11. The method of claim 1, wherein comparing the electrical output of the pixel with the reference comprises integrating the electrical output of the pixel.

12. The method of claim 1, wherein comparing the electrical output of the pixel with the reference comprises sampling the electrical output of the pixel.

13. The method of claim 1, wherein the reference comprises a reference signal, and wherein comparing the electrical output of the pixel with the reference comprises integrating the reference signal.

14. The method of claim 13, wherein the reference signal is integrated for an integration time based on an expected magnitude of the electrical output of the pixel.

15. The method of claim 1, wherein comparing the electrical output of the pixel with the reference comprises combining the electrical output of the pixel with the reference.

16. The method of claim 1, wherein the reference comprises a reference signal, and wherein comparing the electrical output of the pixel with the reference comprises integrating the electrical output of the pixel, integrating the reference signal, and combining the integrated electrical output of the pixel and the integrated reference signal in an integrator.

17. The method of claim 1, wherein comparing the electrical output of the pixel with the reference comprises sampling the electrical output of the pixel and, in a capacitor, combining the sampled electrical output of the pixel and the reference.

18. The method of claim 17, wherein said reference comprises an analog reference value, and wherein comparing the electrical output of the pixel with the reference comprises charging the capacitor to the analog reference value.

19. The method of claim 1, further comprising determining a value of the reference with use of an expected magnitude of the electrical output of the pixel.

20. The method of claim 1, further comprising prior to comparing the electrical output of the pixel with the reference, measuring the electrical output of the pixel.

* * * * *